US006724160B2

(12) United States Patent
Kaufman et al.

(10) Patent No.: US 6,724,160 B2
(45) Date of Patent: Apr. 20, 2004

(54) ION-SOURCE NEUTRALIZATION WITH A HOT-FILAMENT CATHODE-NEUTRALIZER

(75) Inventors: Harold R. Kaufman, Laporte, CO (US); James R. Kahn, Ft. Collins, CO (US); Viacheslav V. Zhurin, Ft. Collins, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 0 days.

(21) Appl. No.: 10/404,162

(22) Filed: Apr. 1, 2003

(65) Prior Publication Data

US 2003/0193295 A1 Oct. 16, 2003

Related U.S. Application Data

(60) Provisional application No. 60/372,158, filed on Apr. 12, 2002.

(51) Int. Cl.[7] ..... H01J 23/00; H01J 7/24

(52) U.S. Cl. ..... 315/500; 315/501; 315/111.81; 315/116; 313/37

(58) Field of Search ..... 315/500, 501, 315/506, 111.81, 111.61, 111.41, 115, 116, 117; 313/15, 13, 37, 547

(56) References Cited

U.S. PATENT DOCUMENTS

| | | | | |
|---|---|---|---|---|
| 3,952,228 A | * | 4/1976 | Reader et al. | 315/111.81 |
| 3,956,666 A | * | 5/1976 | Reader et al. | 315/111.81 |
| 4,458,180 A | * | 7/1984 | Sohval et al. | 315/111.81 |
| 4,684,848 A | * | 8/1987 | Kaufman et al. | 315/111.81 |
| 4,862,032 A | * | 8/1989 | Kaufman et al. | 313/359.1 |
| 4,873,467 A | * | 10/1989 | Kaufman et al. | 313/360.1 |
| 5,274,306 A | | 12/1993 | Kaufman et al. | 315/111.41 |
| 5,525,199 A | | 6/1996 | Scobey | 204/192.26 |
| 6,238,537 B1 | | 5/2001 | Kahn et al. | 204/598.04 |
| 6,454,910 B1 | * | 9/2002 | Zhurin et al. | 204/192.12 |

OTHER PUBLICATIONS

Harper et al.,Modification of Thin Film Properties By Ion Bombardment During Deposition,Chap.4,p.127–162 (1984).

Commonwealth Scientific Corp.,Application Notes, CSC Ion Probe Kit Neutralizer, 1991.

Olson, Ion Milling Induced ESD Damage During MR Head Fabrication, EOS/ESD Symposium 98–332 et seq. (1998).

Zhurin et al.,Physics of closed drift thrusters, Plasma Sources Sci.Technol. 8 (1999), R1–R20.

Kaufman, Ion SOurce Design for Industrial Applications, AIAA 81–0668R, vol. 20, No. 6 (1982), p. 745.

Commonwealth Scientific Corp., Ion Beam Neutralization, p. 1–12 (1991).

Kaufman et al.,Characteristics, Capabilities, and Applications Of Broad–Beam Sources, p. 1–38 (1987).

* cited by examiner

*Primary Examiner*—Haissa Philogene
*Assistant Examiner*—Thuy Vinh Tran
(74) *Attorney, Agent, or Firm*—Dean P. Edmundson

(57) ABSTRACT

In accordance with one embodiment of the present invention, the ion-beam apparatus takes the form of a gridless ion source with a hot-filament cathode-neutralizer, in which the hot filament is heated with a current from the cathode-neutralizer heater. The cathode-neutralizer is connected to the negative terminal of the discharge supply for the gridless ion source. This connection is substantially isolated from ground (the potential of the surrounding vacuum chamber, which is usually at earth ground) and its potential is measured relative to ground. The heater current to the cathode-neutralizer is controlled by adjusting it so as to maintain this potential in a narrow operating range. This control can be manual or automatic.

6 Claims, 8 Drawing Sheets

ION-SOURCE NEUTRALIZATION WITH A HOT-FILAMENT CATHODE-NEUTRALIZER

CROSS-REFERENCE TO RELATED APPLICATION

This application is based upon, and claims the benefit of, our Provisional Application No. 60/372,158, filed Apr. 12, 2002.

FIELD OF INVENTION

This invention relates generally to ion and plasma sources, and more particularly it pertains to the neutralization of the ion beams from such sources with some or all of the electrons from hot-filament cathode-neutralizers.

BACKGROUND ART

Industrial ion sources are used for etching, deposition and property modification, as described by Kaufman, et al., in the brochure entitled *Characteristics, Capabilities, and Applications of Broad-Beam Sources*, Commonwealth Scientific Corporation, Alexandria, Va. (1987).

Both gridded and gridless ion sources are used in these industrial applications. The ions generated in gridded ion sources are accelerated electrostatically by the electric field between the grids. Only ions are present in the region between the grids and the magnitude of the ion current accelerated is limited by space-charge effects in this region. Gridded ion sources are described in an article by Kaufman, et al., in the *AIAA Journal*, Vol. 20 (1982), beginning on page 745. The particular sources described in this article use a direct-current discharge to generate ions. It is also possible to use electrostatic ion acceleration with a radio-frequency discharge, as described in U.S. Pat. No. 5,274,306—Kaufman, et al. These publications are incorporated herein by reference.

In gridless ion sources the ions are accelerated by the electric field generated by an electron current interacting with a magnetic field in the discharge region. Because the ion acceleration takes place in a quasineutral plasma, there is no space-charge limitation on the ion current that can be accelerated in this type of ion source. Because a Hall current of electrons is generated normal to both the applied magnetic field and the electric field generated therein, these ion sources have also been called Hall-current sources. The end-Hall ion source is one type of gridless ion source and is described in U.S. Pat. No. 4,862,032—Kaufman, et al., while the closed-drift ion source is another type of gridless ion source and is described by Zhurin, et al., in an article in *Plasma Sources Science & Technology*, Vol. 8, beginning on page R1. These publications are also incorporated herein by reference.

An end-Hall ion source has a discharge region with only an outside boundary, where the ions are generated and accelerated continuously over the cross section of the region enclosed by the boundary. The shape of this cross section can be circular, elongated, or some other shape as long as there is only an outer boundary to this region.

A closed-drift ion source has a discharge region with both inner and outer boundaries, where the ions are generated and accelerated only over the cross section between these two boundaries. The shape of this cross section is usually of an annular shape. It can also be of an elongated or "racetrack" shape, or some other shape as long as it has two separate and distinct boundaries—usually inner and outer boundaries.

Both gridded and gridless ion sources use electron-emitting cathodes to neutralize the ion beams that are generated, as well as to provide electrons to sustain the discharge. These electron-emitting cathodes are most often called "neutralizers" in publications describing gridded ion sources, and most often called "cathodes" in publications describing gridless ion sources. For consistency, all such electron-emitting cathodes will herein be called "cathode-neutralizers." The most common cathode-neutralizers are the hot-filament, hollow-cathode, and plasma-bridge types, all of which are described in "Ion Beam Neutralization," anon., *CSC Technical Note*, Commonwealth Scientific Corporation, Alexandria, Va. (1991). This publication is also incorporated herein by reference. Because of their reliability, low cost, and simple maintenance, hot-filament cathode-neutralizers are widely used.

Because the neutralized ion beams are also quasineutral plasmas, i.e., the electron density is approximately equal to the ion density, ion sources have also been called plasma sources. It should be noted that the electrons emitted from the cathode-neutralizer do not recombine with the ions in the ion beam. Such recombination depends on three-body collisions that are negligible at the several millitorr or less background pressure in the space between the ion source and the surface struck by the ion beam. There are, however, charge-exchange collisions between energetic beam ions and background neutral atoms or molecules so that some energetic ions become energetic neutrals and some background neutrals become low-energy charge-exchange ions. The number of ions is conserved in the charge-exchange process, so that the number of ions requiring electrons to neutralize their current—whether beam ions or charge-exchange ions—is unchanged by the charge-exchange process.

The proper magnitude of electron emission from the cathode-neutralizer is required to reduce or eliminate electrostatic charging damage to the surfaces near or in the ion beam, particularly the surfaces of targets and deposition substrates. A prior-art method of doing this is to set the cathode-neutralizer emission in a gridded ion source at a magnitude equal to the ion beam current. This is defined as "current neutralization." Current neutralization is obtained in a gridless ion source by setting the cathode-neutralizer emission at a magnitude equal to the discharge current to the anode.

In practice, the two currents are set equal to each other by comparing the readings on two meters and adjusting the emission of the cathode-neutralizer until the two readings are equal. In some cases automatic controls are used to maintain the two currents at the values at which they are set. Even though set equal, the currents can still be unequal due to errors in either reading or calibrating the meters. In addition, the dynamics of control circuits frequently results in departures from current neutralization when operating conditions are changed.

A deficiency in the magnitude of the electron emission from the cathode-neutralizer results in the elevation of the potential within the ion beam until the electron and ion currents at electrically isolated surfaces reach equal magnitudes. When the potential elevation is sufficient, the electron emission from the cathode-neutralizer is augmented by the generation of micro-arcs between the ion beam and the surrounding vacuum chamber, the work piece, or other nearby hardware. These micro-arcs are of very short duration. Depending on the degree of electron emission deficiency, they may be observed with a frequency of one or less per minute up to one or more a second. These micro-arcs result either in direct damage where the micro-arc takes place or indirect damage in the form of particulates generated by the micro-arc and deposited elsewhere.

When the magnitude of the electron emission from the cathode-neutralizer exceeds the ion beam current, the excess electrons are in many cases, but not all, able to flow to the grounded vacuum enclosure or other grounded hardware within that enclosure without generating damaging micro-arcs. The fairly common situation of the ion beam being able to dissipate excess neutralizing electrons without substantial electrostatic charging, together with variations in the accuracy of current measurements, is the justification for the common practice of setting the cathode-neutralizer electron emission somewhat greater than the value required for current neutralization.

Problems have been encountered with electrostatic charging during ion beam etching, as described in an article by Olson in the *EOS/ESD Symposium*, 98–332 (1998). These problems have been most serious when portions of the work piece at which the ion beam is directed are electrically isolated from each other. Differential charging of these isolated portions can result in an electrical breakdown between the two portions. Such a breakdown will damage the work piece.

As described in the aforesaid article by Olson, setting the cathode-neutralizer emission current equal to or greater than the ion beam current in a gridded ion source has been somewhat effective in reducing damage due to electrostatic charging. However, as the devices being etched have used thinner and thinner films, they have become increasingly vulnerable to electrostatic charging damage. At the same time, the increasing miniaturization has resulted in increased cost per wafer. Simply avoiding micro-arcs has not been enough to avoid damage to the expensive devices being etched—generically called "work pieces" herein. Olson describes voltages as low as 6.4 V as being sufficient to cause damage. More recent devices can be damaged by even lower voltages.

Electrostatic charging damage has also been observed when the ion source is used for an ion-assist, or property-modification application and dielectric coatings are being deposited. When the dielectric coating covers most of the exposed conductor area in a vacuum chamber, there is no place for an excess electron emission to go without causing electrostatic charging of the coated surfaces. If the problem is severe enough, small arcs penetrate the dielectric coating to permit the excess electrons to escape. Note that these arcs are the reverse of neutralization arcs in that electrons are escaping from the ion beam, but they can also cause damage to the work pieces.

Another prior-art method to reduce damage due to electrostatic charging has been to measure the potential of the support for the work piece (often called a stage) and to control the emission from the cathode-neutralizer to minimize the potential difference between this support and ground, which is defined as the potential of the surrounding vacuum enclosure and is usually connected to earth ground. This method is described in "CSC Ion Probe Kit Neutralizer," anon., *CSC Application Note*, Bulletin #101-75, Commonwealth Scientific Corporation, Alexandria, Va. (1991). While this method has sometimes been used successfully, it doesn't work reliably when the ion beam strikes surfaces that are covered with electrically-insulating layers.

From a simplified theoretical viewpoint, equal magnitudes of the ion beam current and the electron current that goes to the ion beam from the cathode-neutralizer should permit one electron to arrive at the surface struck by each ion in the ion beam, resulting in no charging of surfaces struck by the ion beam. In practice, there are second-order considerations such as the electric field due to plasma sheaths and the potential variations in the ion beam due to variations in plasma density. However, this simplified approach of having equal magnitudes of electron and ion currents in the ion beam, called current neutralization, has been successfully used when the equality of currents is accurately measured and maintained. Some power-supply circuits employing hollow cathodes have been developed that provide current neutralization precisely and automatically, without the complications or operating problems of sensing, comparing; and controlling two separate currents. These circuits depend on the operating characteristics of the hollow cathode that permit it to automatically adjust to a wide range of electron emission by small variations in operating voltage. Although plasma-bridge cathode-neutralizers have not been used in similar circuits, the similar operating characteristics of hollow-cathode and plasma-bridge cathode-neutralizers would indicate that such use would be possible.

There are no equivalent circuits for hot-filament cathode-neutralizers in which current neutralization is controlled precisely and automatically, without the complications or operating problems of sensing, comparing, and controlling two separate currents. The obstacle is determining the required heater current for this type of cathode-neutralizer. While operation is conceivably possible with some large fixed value of heater current, the lifetime of the hot-filament cathode-neutralizer would be short. To obtain near-maximum lifetime, the heater current must be maintained at a value that provides a margin of electron-emission capability, and, as the hot filament wears and the need for heater current is reduced, the heater current must be continuously reduced while maintaining this margin of electron-emission capability. Here, margin means an excess of electron-emission capability above that required for neutralization. Further, this margin of electron-emission capability must be maintained without actually being able to measure the emission capability (as opposed to the actual emission) of the neutralizer-cathode.

In summary, sensitive and expensive work pieces can be damaged by electrostatic charging. Prior-art techniques have not been adequate to avoid this charging and associated damage when an ion source is used with a hot-filament cathode-neutralizer.

SUMMARY OF INVENTION

In light of the foregoing, it is an object of the invention to provide an ion-beam apparatus using an ion source with a hot-filament cathode-neutralizer that provides current neutralization precisely and automatically.

Another object of the present invention is to provide such an apparatus that provides current neutralization without the complications or operating problems of sensing, comparing, and controlling two separate currents.

Yet another object of the invention is to provide such an apparatus that is simple, economical, and reliable.

Still another object of the present invention is to provide such an apparatus that maximizes the hot-filament lifetime by minimizing the over-heating of the hot-filament cathode-neutralizer used to provide a margin in electron-emission capability.

In accordance with one embodiment of the present invention, the ion-beam apparatus takes the form of a gridless ion source with a hot-filament cathode-neutralizer, in which the hot filament is heated with a current from the cathode-neutralizer heater. The cathode-neutralizer is connected to the negative terminal of the discharge supply for the gridless ion source. This connection is substantially isolated from ground (the potential of the surrounding vacuum enclosure, which is usually at earth ground) and its potential is measured relative to ground. The heater current to the cathode-neutralizer is controlled by adjusting it so as to maintain this potential in a narrow operating range. This control can be manual or automatic.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

It may be noted that some of the aforesaid schematic views contain cross sections or portions of cross sections in which the surfaces in the plane of the section are shown while avoiding the clutter which would result were there also a showing of the background edges and surfaces.

DESCRIPTION OF PRIOR ART

Figure 1:
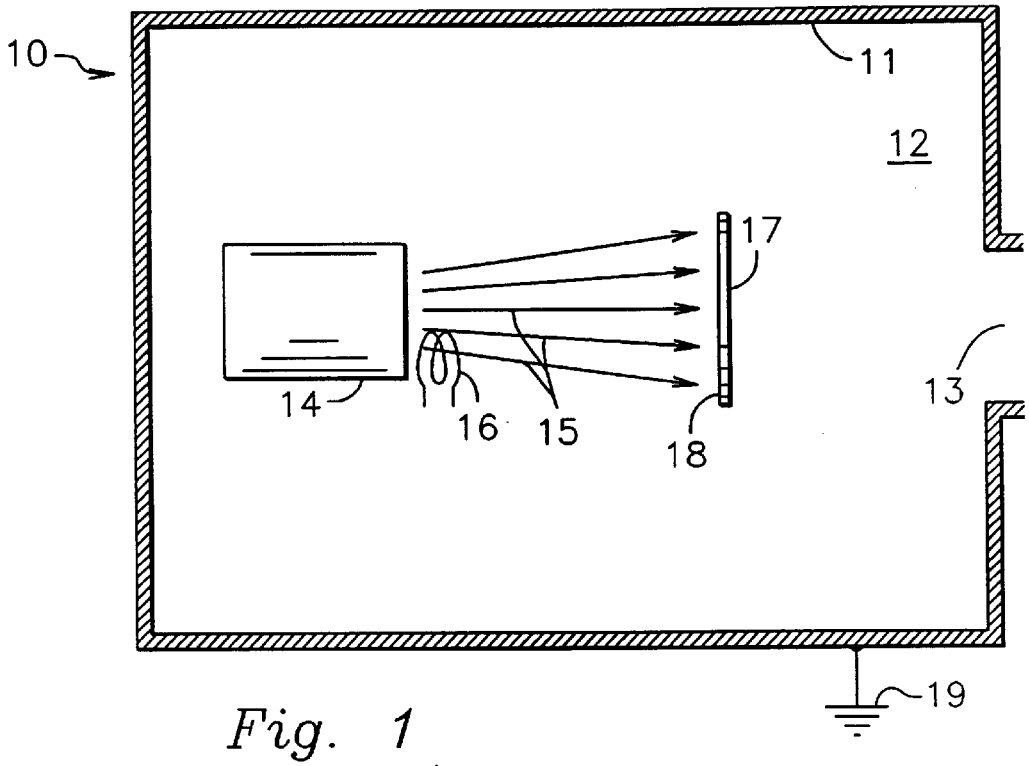
Fig. 1 (PRIOR ART)
FIG. 1 is a prior-art ion-beam apparatus and target.

Referring to FIG. 1, there is shown a prior-art ion-beam apparatus 10 for etching, deposition, or property modification. Other components may be required, such as a deposition substrate for deposition or a source of sputtered or vaporized particles for property modification, but these other components are well-known to those skilled in the art and are not pertinent to the present invention. There is a vacuum enclosure 11 which surrounds evacuated volume 12, with the latter maintained at a low pressure by sustained pumping through port 13. Within the evacuated volume, there is ion source 14. Energetic ion beam 15 generated by ion source 14 is neutralized by cathode-neutralizer 16 and impinges upon target 17, or more specifically upon surface 18 of target 17. The vacuum enclosure 11 is defined as ground 19, and is usually at earth ground. In the event that some of the vacuum enclosure is non-conducting, ground is defined as the potential of that portion that is conducting.

Figure 2:
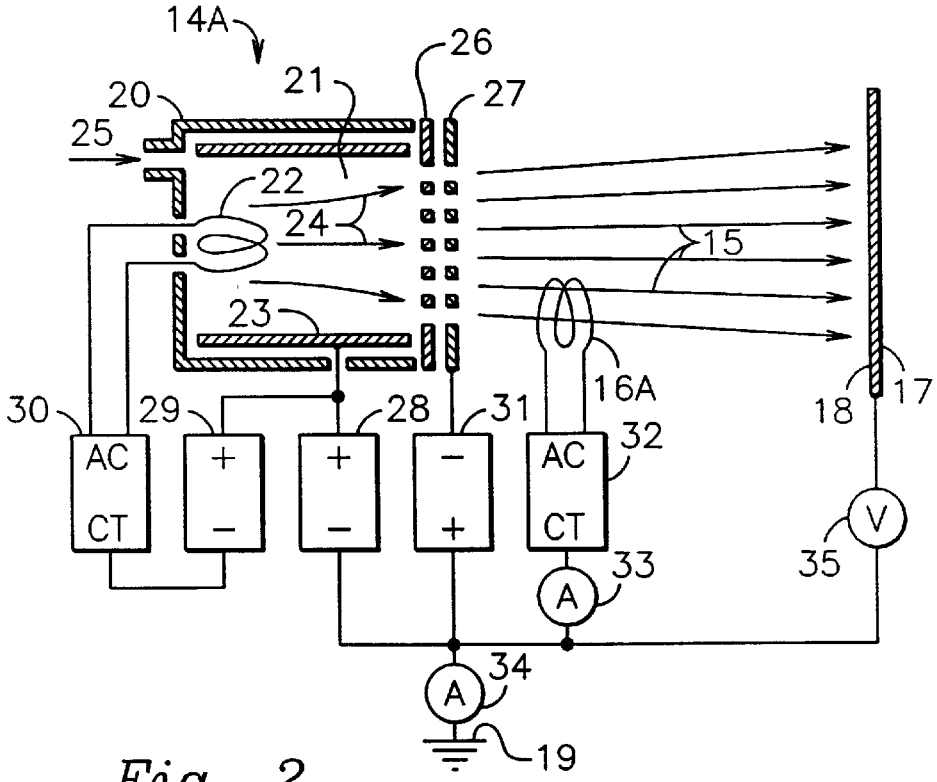
Fig. 2 (PRIOR ART)
FIG. 2 is an electrical circuit diagram of the prior-art ion source and target in FIG. 1 wherein the ion source is of the gridded type and the cathode-neutralizer is of the hot-filament type.
Figure 3:
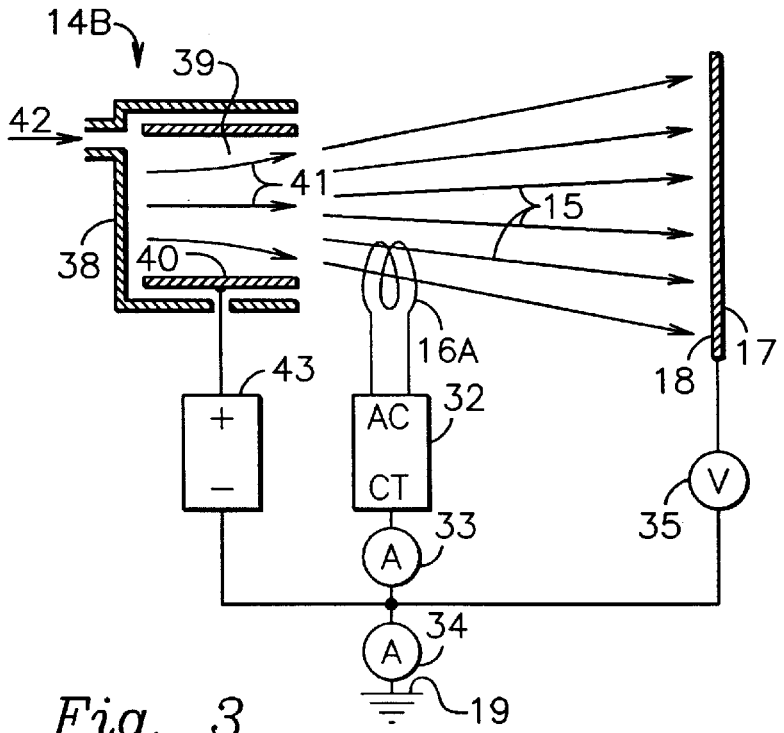
Fig. 3 (PRIOR ART)
FIG. 3 is an electrical circuit diagram of the prior-art ion source and target in FIG. 1 wherein the ion source is of the gridless type and the cathode-neutralizer is of the hot-filament type.

When making a simplified representation of an ion source in an apparatus using one or more ion sources, it is common to show a single block for an ion source, where the ion source is assumed to include a cathode-neutralizer. Examples of such representation are FIG. 1 in U.S. Pat. No. 6,238,537—Kahn, et al.; FIGS. 2, 3, and 5 in U.S. Pat. No. 5,525,199—Scobey; and FIG. 4.3 in chapter 4 by Harper, et al., in *Ion Bombardment Modification of Surfaces: Fundamentals and Applications* (Auciello, et al, eds.), Elsevier Science Publishers B.V., Amsterdam (1984), beginning on page 127. For the purposes of this presentation, however, it is more appropriate to define a cathode-neutralizer as being separate and distinct from the ion source with which it may be associated. It may also be noted that the name "cathode-neutralizer" is used herein for both what is most often called a "neutralizer" in a gridded source and a "cathode" in a gridless source.

Ion source 14 can be of either the gridded or gridless type. Historically, the gridded type has been used more frequently, but the need to reduce film damage by using lower ion energies in ion-assist applications has resulted in the increased use of the gridless type. This is because gridless ion sources are not limited by space charge effects and it is therefore easier to obtain large ion beam currents at low ion energies when using such sources.

Referring to FIG. 2, there is shown the electrical circuit diagram for one version of the prior-art ion source and target shown in FIG. 1, wherein the ion source is of the gridded type. Gridded ion source 14A has outer enclosure 20 that surrounds volume 21. Within this volume there are electron-emitting discharge-chamber cathode 22 and anode 23. Electrons emitted by cathode 22 are constrained by magnetic field 24 and reach anode 23 only as the result of a variety of collision processes. Some of these collisions are with ionizable gas 25 introduced into volume 21 and generate ions. Some of the ions which are generated reach screen grid 26 and accelerator grid 27 and are accelerated out of volume 21 by the negative potential of the accelerator grid. There are apertures in the screen grid and accelerator grid that are aligned with each other, so that in normal operation the accelerated ions continue through the two grids to form ion beam 15. The ions in the ion beam have a positive charge that must be neutralized by the addition of neutralizing electrons, which are emitted by cathode-neutralizer 16A. The neutralized ion beam continues on to strike surface 18 of target 17.

The electrons and ions in volume 21 constitute an electrically conductive gas, or plasma, which is approximately at the potential of anode 23. The electrical potential of beam supply 28 thus determines the potential difference through which the ions "fall," and thus the energy of the ions in ion beam 15. In normal operation (with the energetic accelerated ions not striking accelerator grid 27) the ion current in ion beam 15 equals the current in beam supply 28. The electrical discharge power to generate the ions is supplied by discharge supply 29. Discharge-chamber cathode 22 in FIG. 2 is indicated schematically as being a thermionically-emitting hot filament, where electron emission is obtained by thermionic emission when the filament is electrically heated to an operating temperature beyond the emission threshold. The power to heat this cathode comes from cathode heater supply 30, which is usually in the form of the secondary winding of an alternating-current transformer. The two ends of the transformer secondary winding are attached to the ends of cathode 22, while the negative end of discharge supply 29 is connected to cathode 22 through the center tap (CT) of the secondary winding. Simultaneously obtaining desired values of the discharge-supply voltage and current is accomplished by control of both the discharge supply and cathode heater supply. The discharge-chamber cathode could also be of the hollow-cathode type, which would require a different cathode electrical circuit. Alternatively, the discharge power could be radiofrequency power as opposed to direct-current power, and no discharge-chamber cathode would be required.

The negative accelerator-grid voltage is provided by accelerator supply 31. Cathode-neutralizer 16A in FIG. 2 is also indicated schematically as being a thermionically-emitting hot filament. That is, the cathode is heated to an operating temperature beyond the electron-emission threshold so that electrons are thermionically emitted. Following common terminology, the cathode-neutralizer is described as being a hot filament, but it can be a wire, strip, tube, spiral, or other shape. The power to heat the cathode-neutralizer comes from cathode-neutralizer heater supply 32, which is again usually in the form of the secondary winding of an alternating-current transformer. The two ends of the transformer secondary winding are attached to the ends of cathode-neutralizer 16A, while the cathode-neutralizer is connected through the center tap (CT) of the secondary winding, neutralizer ammeter 33, and ground ammeter 34 to common ground 19 of the vacuum enclosure (11 in FIG. 1). When there is a heater current, the potential of the cathode-neutralizer is not a single value, but extends over a range of potential. Ground 19 is the reference potential for cathode-neutralizer 16A, i.e., a single potential to which the potential, or potential range, of the cathode-neutralizer is closely related. As described previously, ground 19 is usually, but not always, connected to earth ground. Neutralizer ammeter 33 shows the electron emission from cathode-neutralizer 16A. Ground ammeter 34 shows the net current of the ion-source/cathode-neutralizer combination to or from ground 19.

A direct current could be used to heat either the hot-filament discharge-chamber cathode or the hot-filament cathode-neutralizer, but the use of a direct current results in the electron emission always adding to the heater current at one end of the hot filament, resulting in more heating at that end, and a more rapid failure of the hot filament than if an alternating current had been used to average the heating effects at the two ends of the hot filament. The use of the center tap to make the electrical connection to the hot filament is also not necessary, but reduces the magnitude of the positive and negative potential excursions of the cathode-neutralizer relative to the time-averaged mean value when an alternating current is used.

To complete the description of FIG. 2, ion-beam target 17 is shown as being electrically isolated from ground, with the potential of this target relative to ground measured with voltmeter 35, where the voltmeter has a sufficiently high input impedance that it draws negligible current. This isolation is not typical of ion-beam apparatus, but has been used in neutralization tests to determine optimum operating conditions for cathode-neutralizers.

It may be noted that there are two different kinds of neutralization of ion beam 15 with electrons from cathode-neutralizer 16A. Charge neutralization is the approximate equal densities of electron and ion charges in the ion beam. Charge neutralization is generally required for even a rough approximation of normal operation of the ion source. Even in the absence of an operating neutralizer, the micro-arcs described in the Background Art section often assure charge neutralization.

The second kind of neutralization is more difficult to obtain and is called "current neutralization." Experimentally, a near-minimum absolute potential of target 17 relative to ground is obtained with a gridded ion source when the ion beam current (the current in beam supply 28) equals the magnitude of the electron emission from the cathode-neutralizer. The equality, $$I_i = I_e \tag{1}$$

where $I_i$ is the ion-beam current and $I_e$ is the magnitude of the electron emission from the cathode-neutralizer, is defined as current neutralization for a gridded ion source. As described in the Background Art section, the need to reduce charging damage in industrial applications has resulted in increasingly rigorous requirements for satisfying this equality.

For a normally grounded target, the condition of current neutralization greatly reduces the likelihood of charging damage at the target surface 18 when that surface is partially or completely isolated from target 17 by dielectric coatings or layers.

Current neutralization can be obtained using the electrical circuit shown in FIG. 2 by adjusting the current from heater supply 32 so that the electron emission as indicated by the absolute current through ammeter 33 is equal to the beam current through beam supply 28. Alternatively, the current from heater supply 32 can be adjusted so that the net current of the ion-source/neutralizer-cathode combination to or from ground 19, as shown by ground ammeter 34, is zero. Either of these adjustments can be done manually or automatically with an electronic control. Note that the current of accelerator supply 31 is included in the current to ground. The accelerator current is normally small compared to either the beam current or the electron emission from the cathode-neutralizer, so that there is usually no practical significance of this inclusion.

Referring to FIG. 3, there is shown the electrical circuit diagram for another version of the prior-art ion source and target shown in FIG. 1, where ion source 14B is a gridless one. The gridless ion source in FIG. 3 could be of either the end-Hall type or the closed-drift type. This is because the electrical circuit is the same for both types, despite the topological difference in discharge regions described in the Background Art section. Gridless ion source 14B has outer enclosure 38 that surrounds volume 39. Within this volume there are anode 40 and magnetic field 41. Electrons emitted by cathode-neutralizer 16A are constrained by the magnetic field and reach the anode only as the result of a variety of collision processes. Some of these collisions are with ionizable gas 42 introduced into volume 39 and generate ions. Some of the ions generated are accelerated out of volume 39 by the electric field generated by the interaction of the electron current in volume 39 with the magnetic field 41 in the same volume, to form ion beam 15. The ions in the ion beam have a positive charge that must be neutralized by the addition of neutralizing electrons from cathode-neutralizer 16A.

The electrical discharge in volume 39 is energized by discharge supply 43. The discharge supply has also been called the anode supply in some literature. The electrical potential of the discharge supply determines the ion energy of the ions in ion beam 15, but the ion energy generally corresponds to only 60–90 percent of the discharge voltage depending on the specific type of gridless ion source and its specific operating condition. In a similar manner, the ion current in the ion beam corresponds to only 20–90 percent of the discharge current. Cathode-neutralizer 16A in FIG. 3 is again indicated as being a thermionically-emitting hot filament. The power to heat this cathode comes from cathode-neutralizer supply 32, which is usually in the form of a secondary winding of an alternating-current transformer. The two ends of the transformer secondary winding are attached to the ends of cathode-neutralizer 16A. The cathode-neutralizer is connected through the center tap (CT) of the secondary winding, neutralizer ammeter 33, and ground ammeter 34 to common ground 19 of the vacuum enclosure (11 in FIG. 1). As was described in connection with FIG. 2, ground 19 is the reference potential for cathode-neutralizer 16A. That is, ground is a single potential to which the potential, or potential range, of the cathode-neutralizer is closely related. As described previously, ground 19 is usually, but not always, connected to earth ground. Neutralizer ammeter 33 again shows the electron emission from cathode-neutralizer 16A. Ground ammeter 34 shows the net current of the ion-source/cathode-neutralizer combination to or from ground 19. To complete the description of FIG. 3, ion-beam target 17 is again electrically isolated from ground, with the potential of this target relative to ground measured with voltmeter 35.

Current neutralization for a gridless ion source is defined by the equality, $$I_d = I_e \tag{2}$$

where $I_d$ is the discharge current through discharge supply 43 and $I_e$ is the magnitude of the electron emission from the cathode-neutralizer as measured by ammeter 33.

The above definition can be justified using FIG. 3. The discharge current, $I_d$, leaving volume 39 of ion source 14B consists of the electron current, $I_e'$, emitted from cathode 16A that enters that volume and the ion current, $I_i'$, that leaves that volume to form ion beam 15. The discharge current is thus $$I_d = I_e' + I_i, \tag{3}$$

where $I_e'$ is the magnitude of the electron current into volume 39 and $I_i$ is the magnitude of the ion current leaving it. Because of the continuity of current, the discharge current at the anode has the same value as given by Equation (3). The ions are formed in electron-ion pairs, however, so that anode current consists of the electron current that flows into volume 39, $I_e'$, plus an electron current equal to the ion-beam current leaving that source, $I_i$. The electron current at the anode thus equals $I_d$ as given by Equation (3), but at the anode the current is almost entirely due to electrons. For a current-neutralized ion beam, the magnitude of the electron emission from cathode-neutralizer 16A must equal $I_e'$ plus an electron current equal to the ion-beam current, $I_i$.

$$I_e = I_e' + I_i \tag{4}$$

Inasmuch as $I_d$ and $I_e$ are both equal to $I_e'+I_i'$, Equation (2) is shown to be consistent with a current neutralized ion beam for a gridless ion source.

Current neutralization can be obtained using the electrical circuit shown in FIG. 3 by adjusting the current from heater supply 32 so that the electron emission as indicated by the absolute current through ammeter 33 is equal to the discharge current through discharge supply 43. Alternatively, the current from heater supply 32 can be adjusted so that the net current of the ion-source/neutralizer-cathode combination to or from ground 19, as shown by ground ammeter 34, is zero. Either of these adjustments can be done manually or automatically with an electronic control.

Figure 4:
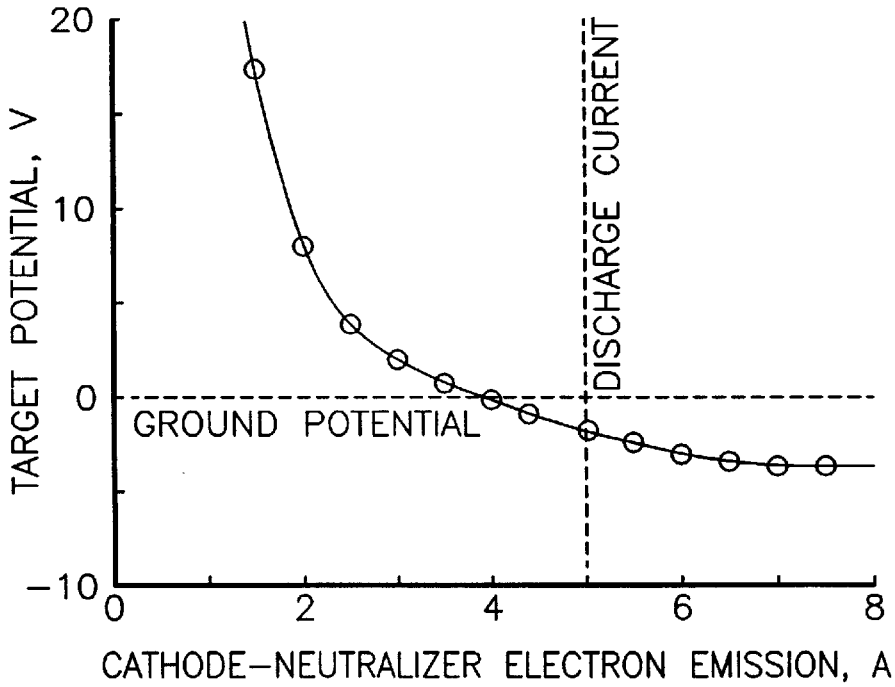
Fig. 4 (PRIOR ART)
FIG. 4 depicts the variation in potential of an electrically isolated target with cathode-neutralizer emission wherein the ion source is of the type shown in FIG. 3 and the discharge current and the gas flow are kept constant.
Figure 5:
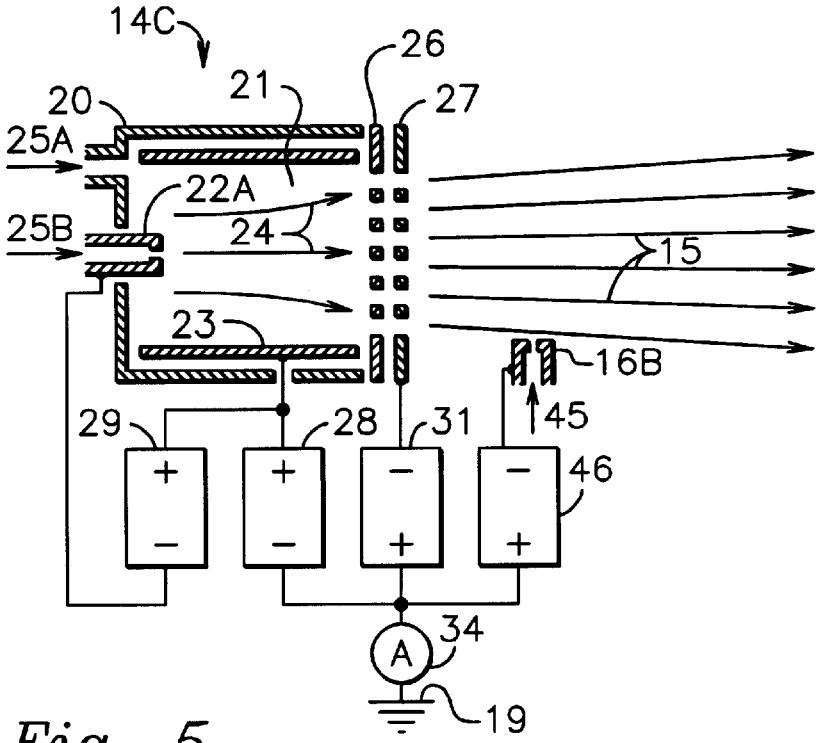
Fig. 5 (PRIOR ART)
FIG. 5 is an alternate electrical circuit diagram of the prior-art ion source and target in FIG. 1 wherein the ion source is of the gridded type and the discharge-chamber cathode and cathode-neutralizer are both of the hollow-cathode type.

The variation of the potential of electrically isolated ion-beam target 17 with the cathode-neutralizer emission is depicted in FIG. 4 for an ion-beam apparatus corresponding to both FIG. 1 and the electrical circuit diagram of FIG. 3. To permit the target potential to indicate the degree of neutralization obtained, no dielectric coating was present on surface 18 of target 17. The ion source used was the commercially available Mark II end-Hall ion source manufactured originally by Commonwealth Scientific Corporation and presently by Veeco Instruments Inc. The ion source was operated at a fixed discharge current (the current in discharge supply 43) of 5 A, a discharge voltage of about 150 V, and a fixed flow of ionizable gas 42 consisting of 22 sccm (standard cubic centimeters per minute) of argon. The variation of cathode-neutralizer emission (the current indicated by ammeter 33) then results in the variation of target potential (measured by voltmeter 35) shown in FIG. 4. Of particular interest is the target potential near zero potential relative to ground (actually −2 V) at a cathode-neutralizer emission, $I_e'$, equal in magnitude to the 5 A discharge current, $I_d'$.

If the cathode-neutralizer emission exceeds the discharge current, the electron arrival rate at the target will exceed the ion arrival rate and the potential of an electrically isolated target will become more negative, as shown in FIG. 4, to reflect some of the arriving electrons. If the cathode-neutralizer emission is less than the discharge current, the potential of an electrically isolated target will become more positive to attract more of the arriving electrons, as also shown in FIG. 4.

The magnitude of the target potential variation depends on the target area involved. The target 17 used for the data shown in FIG. 4 was only 2.0 square centimeters located at 30 cm from the ion source. When the target area was increased to over 700 square centimeters (a 30-cm diameter target again at a distance of 30 cm), the variation became much larger, particularly for a reduction in electron emission below the discharge current. In short, the larger the target surface that is electrically isolated from ground, the greater the variation in target potential for a given departure from current neutralization, and the greater the likelihood of electrostatic charging damage.

As described in the Background Art section, there are second-order considerations such as the electric field due to plasma sheaths and the potential variations in the ion beam due to variations in plasma density. However, current neutralization, as defined by Equation (1) for a gridded ion source and Equation (2) for a gridless ion source, represents the best overall strategy for reducing and controlling surface damage to targets and deposition substrates due to electrostatic charging.

Referring now to FIG. 5, there is shown the electrical circuit diagram for yet another version of the prior-art ion source and target shown in FIG. 1, wherein the ion source is of the gridded type and both discharge-chamber cathode 22A and cathode-neutralizer 16B are of the hollow-cathode type. For the purposes of this invention, the neutralizer and neutralizer power supply comprise the significant differences from the otherwise similar circuit diagram of FIG. 2. Ionizable gas 45 is introduced to cathode-neutralizer 16B, with ionizable gas 45 separate from ionizable gas 25A introduced into ion-source volume 21 and ionizable gas 25B introduced to that volume through cathode 22A. Simultaneously obtaining desired values of the discharge-supply voltage and current is accomplished by control of both the discharge supply and the flow of ionizable gas through the discharge-chamber cathode. The starting of the discharge in a hollow-cathode cathode-neutralizer is well-understood by those skilled in the art and generally requires one or more additional power supplies and electrodes that are not shown in FIG. 5. Once started, the hollow-cathode discharge is sustained by a potential difference between the cathode and the effective anode, in this case ion beam 15. This potential is set by neutralizer bias supply 46, and controls the electron emission. The electron emission from cathode-neutralizer 16B is identical to the current through neutralizer supply 46, so that ammeter 33 shown in FIGS. 2 and 3 is not required to measure the electron emission for the circuit in FIG. 5.

Current neutralization is obtained with the circuit shown in FIG. 5 in a manner similar to that for the circuit of FIG. 2, except that the potential of bias supply 46 (FIG. 5) is used to control electron emission instead of the current from heater supply 32 (FIG. 2).

Figure 6:
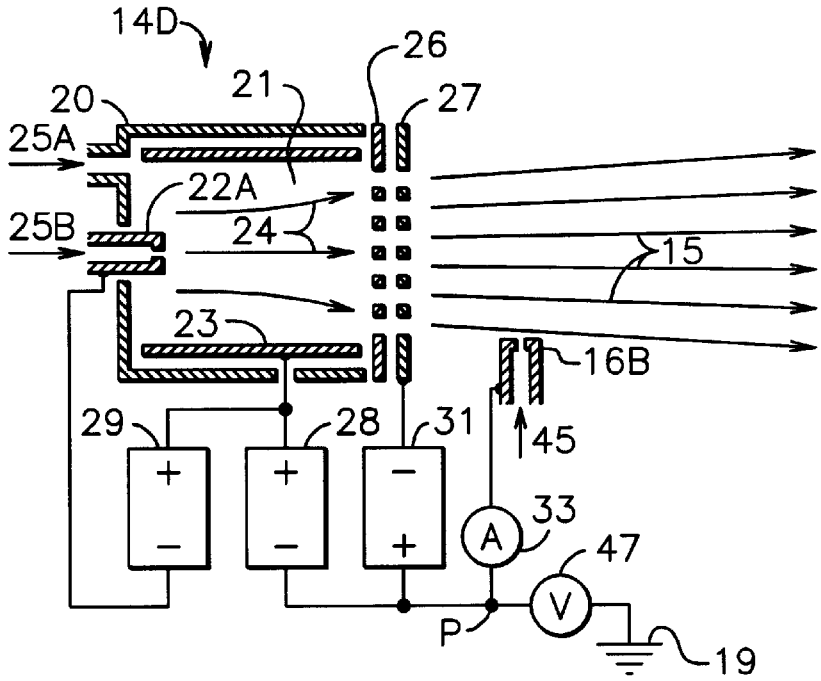
Fig. 6 (PRIOR ART)
FIG. 6 is an another alternate electrical circuit diagram of the prior-art ion source and target in FIG. 1 similar to that shown in FIG. 5, but where current neutralization is automatically provided by a simple, self-regulating circuit.

Still another version of the prior-art ion source and target shown in FIG. 1 is the electrical circuit diagram of FIG. 6. This circuit is generally similar to that of FIG. 5, except that there is no bias supply 46 (FIG. 5) and common circuit point P (FIG. 6) is electrically isolated from ground 19 instead of being connected through ammeter 34 (FIG. 5). The potential of point P is measured relative to that of ground with voltmeter 47 (FIG. 6), where the voltmeter again has a sufficiently high input impedance that it draws negligible current.

The starting of the discharge in a hollow-cathode cathode-neutralizer is again well-understood by those skilled in the art. Once started, however, the potential difference of bias supply 46 is replaced by the potential difference between point P and ground 19. If the electron emission from cathode-neutralizer 16B exceeds the beam current through beam supply 28, electrons will be depleted at point P, causing the potential at point P to increase and the electron emission to decrease. Conversely, if the electron emission from cathode-neutralizer 16B is less than the beam current through beam supply 28, electrons will accumulate at point P, causing the potential at point P to decrease and the electron emission to increase. In this manner, any imbalance between the electron emission and the beam current is automatically corrected by a change in potential of point P. Because the stored charge at point P is quite small, the correction of any current imbalance is quite rapid.

The self-correcting current neutralization of the circuit of FIG. 6 is unusual in ion source technology. To the best knowledge of the applicants, the circuit of FIG. 6 has been used only in the simulation of space operation for gridded ion thrusters (ion sources used for space propulsion), and not in industrial applications. There is, however, no apparent reason it could not be used in industrial applications.

Figure 7:
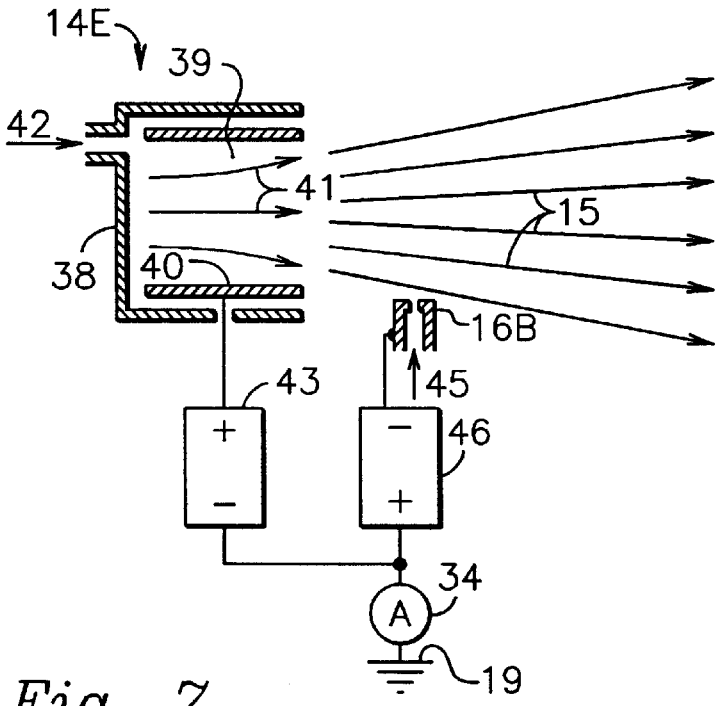
Fig. 7 (PRIOR ART)
FIG. 7 is an electrical circuit diagram of the prior-art ion source and target in FIG. 1 wherein the ion source is of the gridless type and the cathode-neutralizer is of the hollow-cathode type.
Figure 8:
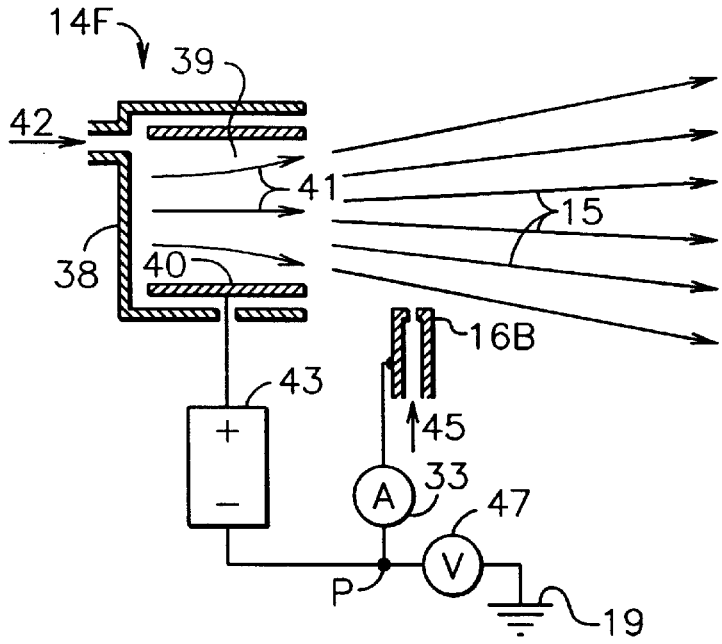
Fig. 8 (PRIOR ART)
FIG. 8 is an alternate electrical circuit diagram of the prior-art ion source and target in FIG. 1 wherein the ion source is of the gridless type, the cathode-neutralizer is of the hollow-cathode type, and current neutralization is automatically provided by a simple, self-regulating circuit.

Additional circuit diagrams for other versions of the prior-art ion source and target shown in FIG. 1 are presented in FIGS. 7 and 8. Gridless ion sources and hollow-cathode cathode-neutralizers are used in both circuits. In FIG. 7, the electron emission of the cathode-neutralizer is controlled by bias supply 46, in a manner similar to that described for FIG. 5. In FIG. 8, the electron emission of the cathode-neutralizer is automatically regulated to give current neutralization by the potential of common circuit point P, in a manner similar to that described for FIG. 6. The self-regulating current neutralization of the circuit of FIG. 8, is also unusual, but has been used both in industrial applications of gridless ion sources and in space simulation for gridless thrusters.

The prior-art control of the heater supply for hot-filament cathode-neutralizer (FIGS. 2 and 3) has used the emission current, which has the continuous, monotonic character desired in control circuits. The prior art has no similar self-regulating circuit for a hot-filament cathode-neutralizer. The emission current in the self-regulating circuits of FIGS. 6 and 8 is not permitted to vary in normal operation, when current neutralization is obtained, hence could not be used to control the heater current if a hot-filament cathode-neutralizer were used in a similar circuit.

DESCRIPTION OF PREFERRED EMBODIMENTS

Figure 9:
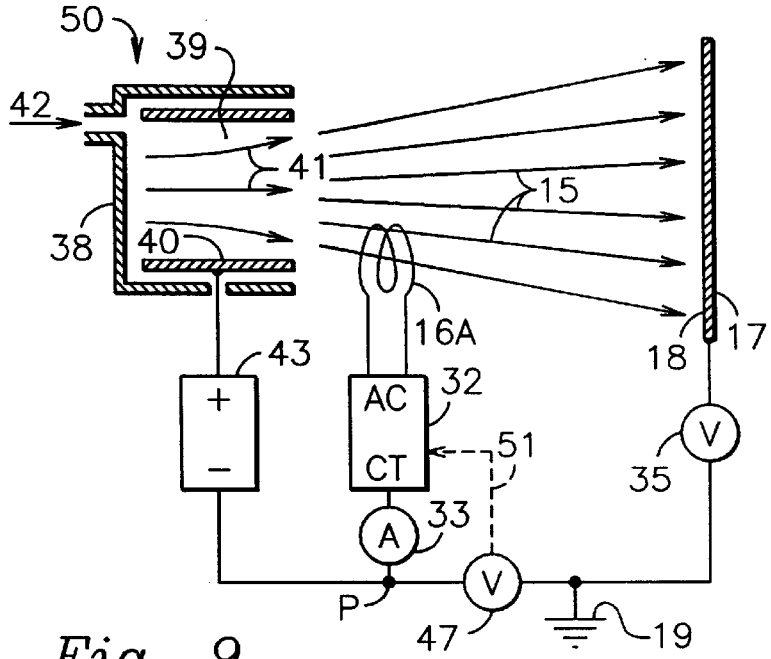
FIG. 9 is an embodiment of the present invention wherein the ion source is of the gridless type.

Referring to FIG. 9, there is shown ion-source apparatus 50 that is an embodiment of the present invention wherein the ion source is of the gridless type. As in discussions of prior art, the gridless ion source in FIG. 9 could be of either the end-Hall or the closed-drift types. This apparatus is generally similar to the ion source apparatus 14B in FIG. 3, except that the electron emission is self-regulating in a manner previously only obtained with hollow-cathode cathode-neutralizers.

Operation of the ion source is generally similar to that described for FIG. 3. Gridless ion source 50 has outer enclosure 38 that surrounds volume 39. Within this volume there are anode 40 and magnetic field 41. Electrons emitted by cathode-neutralizer 16A are constrained by the magnetic field and reach the anode only as the result of a variety of collision processes. Some of these collisions are with ionizable gas 42 introduced into volume 39 and generate ions. Some of the ions generated are accelerated out of volume 39 by the electric field generated by the interaction of the electron current in volume 39 with the magnetic field 41 in the same volume, to form ion beam 15. The ions in the ion beam have a positive charge that must be neutralized by the addition of neutralizing electrons from cathode-neutralizer 16A.

The electrical discharge in volume 39 is again energized by discharge supply 43. The two ends of the transformer secondary winding are again attached to the ends of cathode-neutralizer 16A, while the cathode-neutralizer is connected through the center tap (CT) of the secondary winding of heater supply 32 to neutralizer ammeter 33. The heater current generated by the heater supply is again sufficient to raise the cathode neutralizer to an operating temperature beyond the electron-emission threshold. An important difference from FIG. 3, however, is that the other side of ammeter 33 is connected not to ground 19 (through ground ammeter 34), but to electrically isolated circuit point P. The vacuum enclosure (11 in FIG. 1) is again defined as ground, and is usually at earth ground. In the event that some of the vacuum enclosure is non-conducting, ground is defined as the potential of that portion that is conducting. When there is a heater current, the potential of the cathode-neutralizer is again not a single value, but extends over a range of potential. Point P is the reference potential for cathode-neutralizer 16A, i.e., a single potential to which the potential, or potential range, of the cathode-neutralizer is closely related. This differs from the prior art of FIG. 3, where ground 19 was the reference potential.

Figure 10:
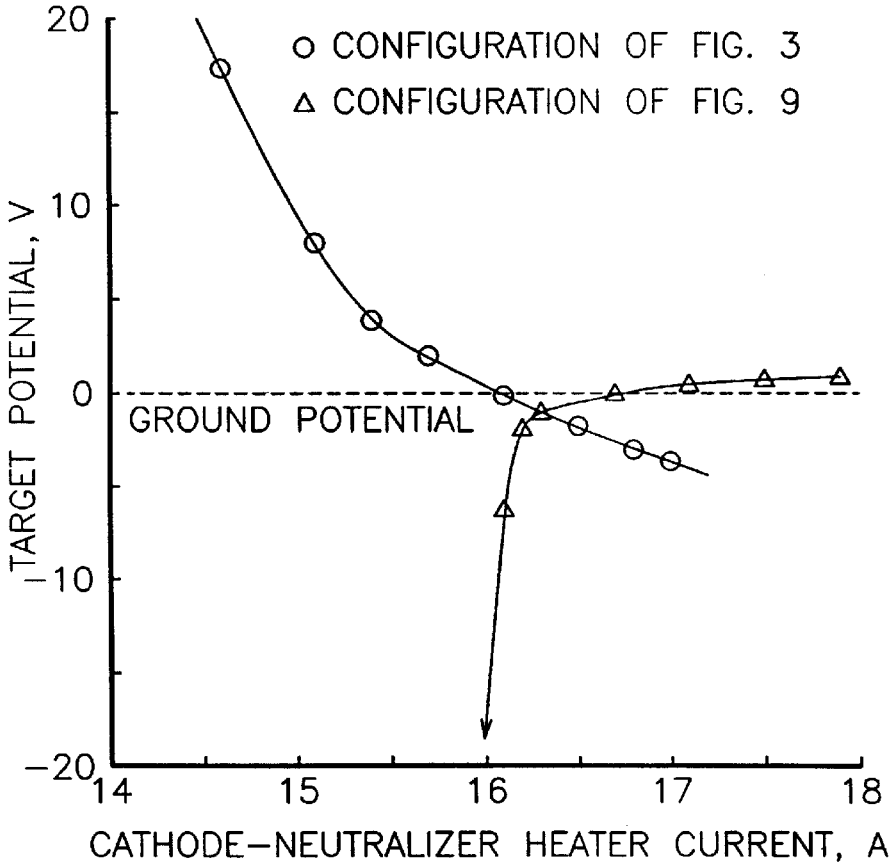
FIG. 10 depicts the variation in potential of an electrically isolated target with cathode-neutralizer heater current for both the embodiment of the present invention shown in FIG. 9 and the prior-art ion-beam apparatus shown in FIG. 3, with the discharge current and gas flow in both cases kept constant.

The target potential as measured by voltmeter 35 is shown in FIG. 10 for the apparatus of FIG. 9 when operated over a range of cathode-neutralizer heater current from heater supply 32. As for the test described in connection with FIG. 4, no dielectric coating was present on surface 18 of target 17. The ion source used was again the commercially available Mark II end-Hall ion source manufactured originally by Commonwealth Scientific Corporation and presently by Veeco Instruments Inc. The ion source was again operated at a fixed discharge current (the current in discharge supply 43) of 5 A, a discharge voltage of about 150 V (this voltage varied slightly with cathode heater current), and a fixed flow of ionizable gas 42 consisting of 22 sccm of argon. The target potential was plotted against cathode heater current rather than cathode-neutralizer emission because the circuit of FIG. 9 forced the emission to be constant at 5 A, i.e., equal to the discharge current. The only noticeable change over the range of cathode heater current was the rapid fluctuations in potentials and currents as the heater current dropped below about 16.2 A, indicating that the electron emission from the cathode-neutralizer had dropped to less than 5 A and the deficit in emission compared to discharge current was being made up with arcing. The target 17 used for the data shown in FIG. 4 was again 2.0 square centimeters located at 30 cm from the ion source. When the target area was again increased to over 700 square centimeters, operation with circuit point P negative of ground became impractical due to large fluctuations in ion source operation.

Also plotted in FIG. 10 are the prior-art data from FIG. 4, where they were plotted against electron emission. The cathodes in both tests were nearly new, so that the same heater current resulted in approximately the same capability for electron emission. But, as described above, the actual electron emission obtained with the circuit of FIG. 9 was held to 5 A when the capability for electron emission equalled or exceeded 5A.

Figure 11:
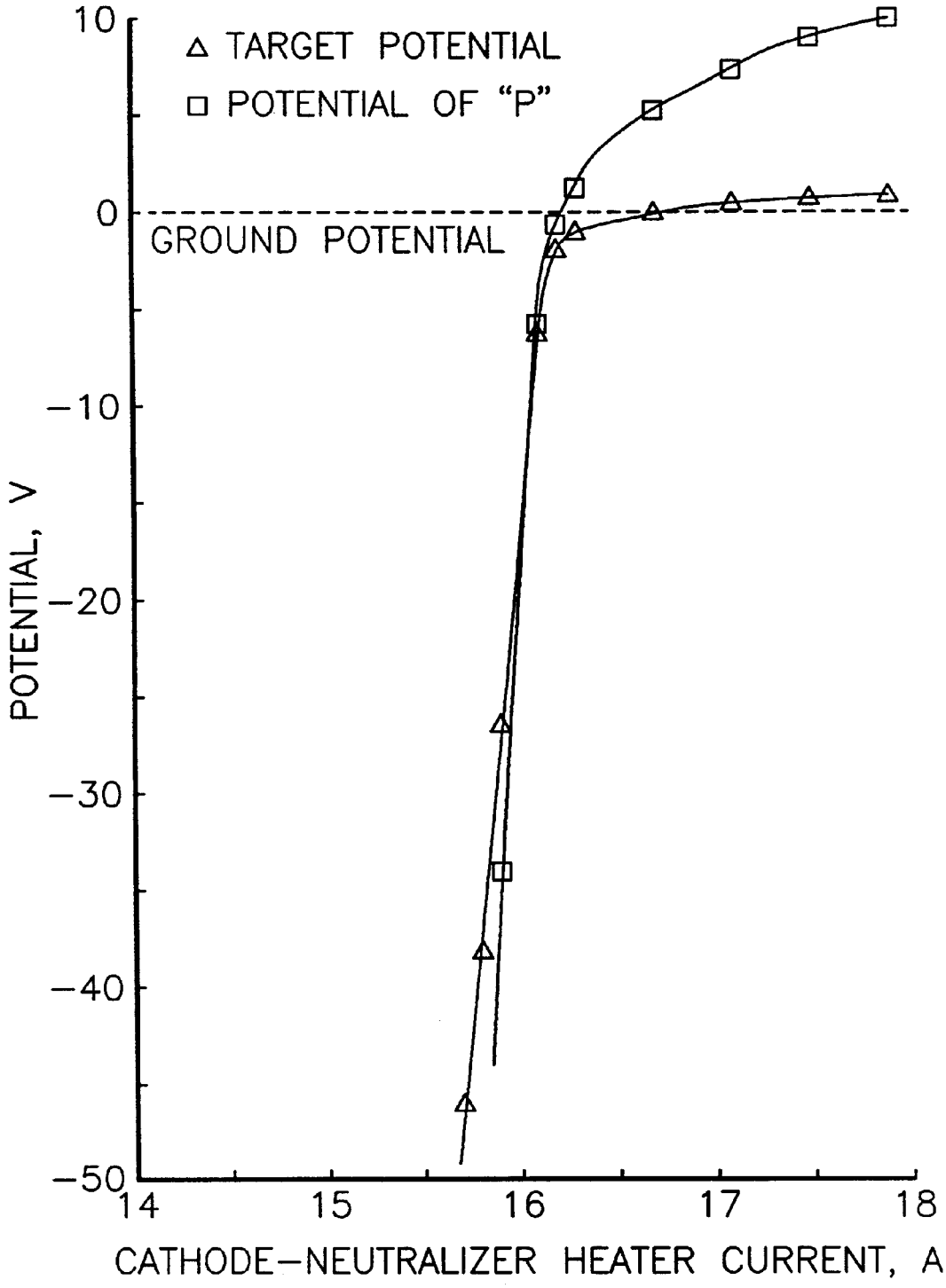
FIG. 11 depicts the variation in potential of both an electrically isolated target and electrically isolated circuit point P with cathode-neutralizer heater current for the embodiment of the present invention shown in FIG. 9, with the discharge current and gas flow kept constant.

Referring now to FIG. 11, there is shown both the target potential as measured by voltmeter 35 and the potential of common circuit point P as measured by voltmeter 47, with both plotted against cathode-neutralizer heater current from heater supply 32. The apparatus was again consistent with the circuit diagram of FIG. 9 and a commercially available Mark II was again operated at a discharge current of 5 A and a fixed flow of ionizable gas consisting of 22 sccm of argon. The target potentials are the same data points as shown for the same circuit in FIG. 10, except that data is shown over a wider range of voltage in FIG. 11.

The potential of point P is zero at a heater current of about 16.2 A. This means that point P could be connected to ground 19 and not have any current flow to or from ground. At a heater current of 16.2 A, then, not only is the electron emission 5 A, but the operation is identical with that of the circuit of FIG. 3 when the electron emission is 5 A. Of particular interest is the fact that the target potential is nearly constant over a wide range of heater current above 16.2 A. At the same time the potential of point P increases continuously with increased heater current above 16 A. While the circuit of FIG. 9 requires that the ion beam be current neutralized above 16.2 A, the potential of point P rises to prevent the increased capability for electron emission to be reflected in an increased actual emission. The increase in the potential of point P thus serves as an indicator of increased emission capability.

The use of the voltage of voltmeter 47 to control the heater current generated by heater supply 32 is indicated by dashed line 51 in FIG. 9. If the potential of point P as indicated by the voltage of voltmeter 47 rises above a predetermined range, the heater current is reduced, causing the potential of point P to decrease. If the potential of point P decreases below a predetermined range, the heater current is increased, causing the potential of point P to increase. This control may be either manual or automatic. Although a potential close to +5 V was given above as the range of values within which the potential of point P was controlled, other ranges of values could be used to control the heater current, so that the electron emission capability can be controlled with more or less margin compared to the actual electron emission.

To show the importance of the potential of point P as an indicator of emission capability, consider operation without its use. A duration test of a hot-filament cathode-neutralizer was carried out using a Mark II ion source. With the heater current fixed at a value sufficient to assure current neutralization of a 5 A discharge at the beginning of life (20 A), operation with argon at a discharge voltage of 150 V and an argon background pressure of about $2\times10^{-4}$ Torr (0.03 Pascals), the cathode lifetime was 3.4 hours. When the heater current was adjusted to maintain the potential of point P within a narrow range near +5 V, the lifetime was increased to 5.1 hours, which, within experimental error, is equal to the lifetime at the same operating conditions using the prior-art circuit of FIG. 3.

The reason for the lifetime difference is the large variation in cathode-neutralizer heater current over the lifetime. The heater current typically drops about 40% from beginning to end of life, with the rate of drop depending on the gas used in the ion source, the flow rate of this gas, the background gas and pressure, and the discharge voltage and current. A heater current that is just sufficient for current neutralization at beginning of life is therefore excessive near the end of life—resulting in an early failure. Quantitatively, the potential of point P being in a narrow range near +5 V corresponded to an excess in heater current of about 0.5 ampere over the 16.2 A minimum required for current neutralization near beginning of life. In comparison, the wear of a cathode over a normal operating lifetime results in a drop in heater current of over 6 A for the operating condition shown in FIG. 10. Operating at a potential of point P near +5 V thus permits a moderate excess in heater current over the cathode lifetime, compared to a fixed heater current approaching the end of life with a excess of more than 6 A.

Figure 12:
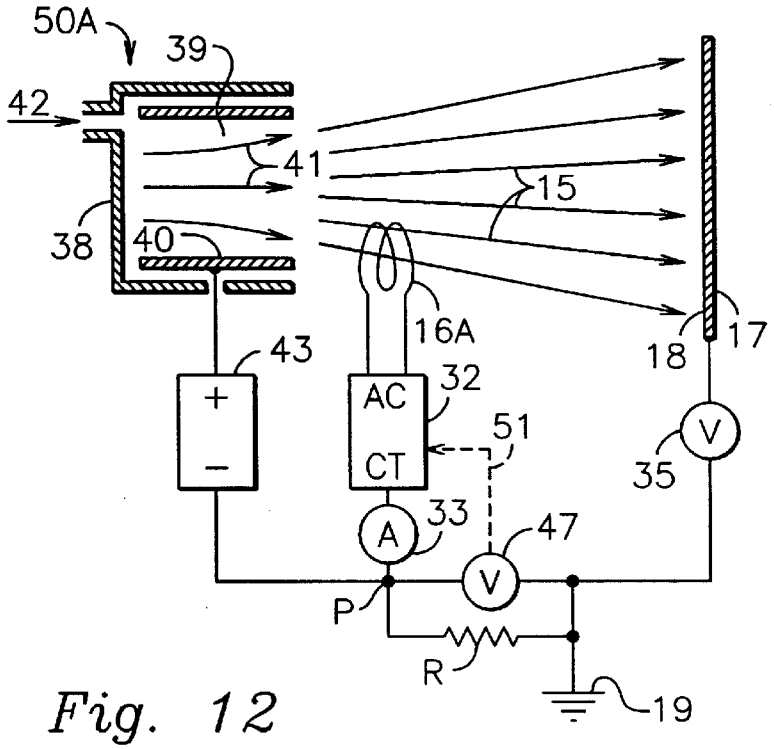
FIG. 12 is another embodiment of the present invention wherein the ion source is of the gridless type and the electrical isolation of circuit point P from ground is modified with resistor R.

Referring to FIG. 12, there is shown ion-source apparatus 50A that is also an embodiment of the present invention wherein the ion source is of the gridless type. Ion-source apparatus 50A differs from ion-source apparatus 50 in FIG. 9 by the addition of resistor R between common circuit point P and ground 19. Tests were conducted with three different values of resistor R. The highest value, 150 kΩ, was sufficiently high to result in negligible departure from current neutralization and was, in fact, the actual resistance used for the data in FIGS. 10 and 11. For example, at a potential of +5 V at point P, the current through resistor R is 33 $\mu$A, so that the departure from exact current neutralization would be only $7\times10^{-4}$ of the 5 A ion-beam current.

Figure 13:
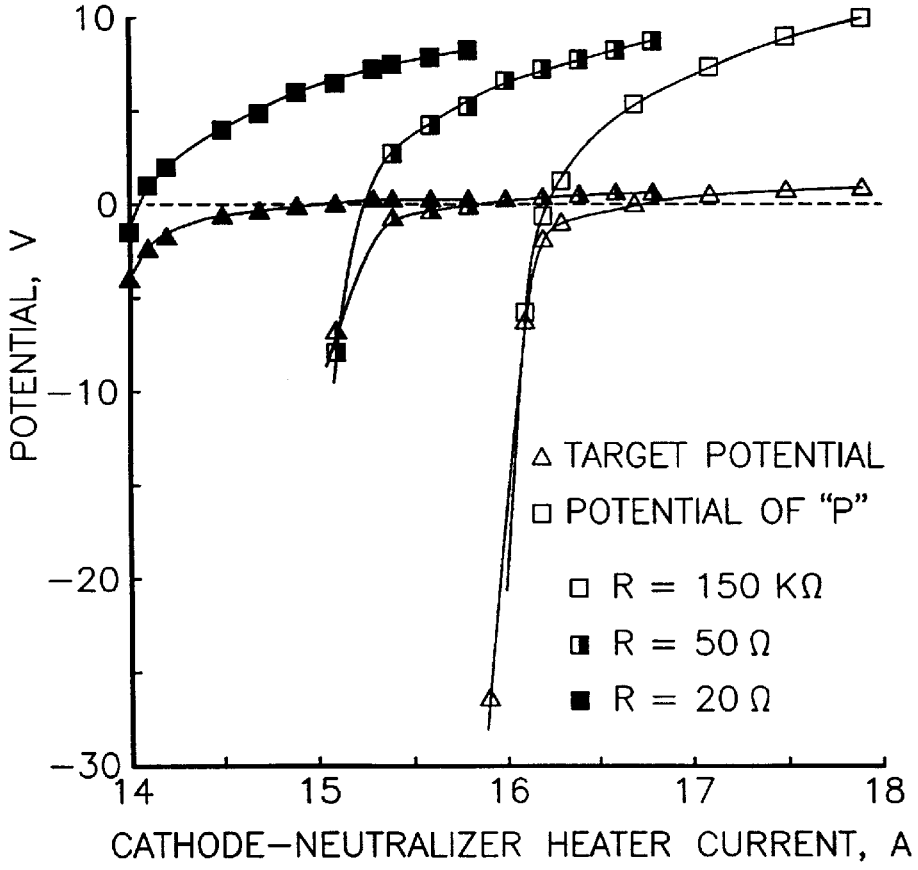
FIG. 13 depicts the variation in potential of both an electrically isolated target and electrically isolated circuit point P with cathode-neutralizer heater current for the embodiment of the present invention shown in FIG. 9, with the discharge current and gas flow kept constant and three different values of resistor R are used.

The potentials of target 17 and common circuit point P relative to ground 19 are plotted against cathode-neutralizer heater current in FIG. 13 for the three values of resistor R. The effects of the resistor value on the operation are small. For example, the maximum positive voltage of point P shown in FIG. 13 is about 10 V. The current through the lowest resistance of 20 Ω would be about 0.5 A at this voltage. This current could be compensated for by a change in heater current of about 0.1–0.2 A. The difference of heater current of over 2 A between a resistance of 150 kΩ and 20 Ω for the same potential of point P is thus not due to the presence of resistor R, but is due instead to erosion of the cathode. The test with a resistance of 150 kΩ was carried out first with a nearly new cathode-neutralizer. The test with 50 Ω was carried out later after some erosion of the cathode. The test with 20 Ω was carried out last after the most erosion. As far as operating characteristics are concerned, the necessary electrical isolation of point P relative to ground depends primarily on the desired accuracy for current neutralization. For the +5 V operating point used previously, a 20 Ω resistance would lead to an excess of electron emission over the discharge current of 0.25 A, or 5%. This degree of precision would be adequate for many ion-beam applications.

Common circuit point P is defined as being "substantially isolated" from ground, where the precise resistance required for substantial isolation depends on the precise accuracy desired for current neutralization.

The data of FIG. 13 support another conclusion. Although shifted in heater current, primarily due to cathode erosion as described above, the curves for different resistances for R have similar shapes. For example, the potential difference between 0 and +5 V for point P corresponds to a difference in heater current of 0.4–0.6 A for the three different cathode-neutralizer operating times. Control 51 (FIG. 12), either manual or automatic, is therefore expected to operate in a similar manner over the cathode-neutralizer lifetime as it erodes and the heater current becomes smaller.

ALTERNATE EMBODIMENTS

Figure 14:
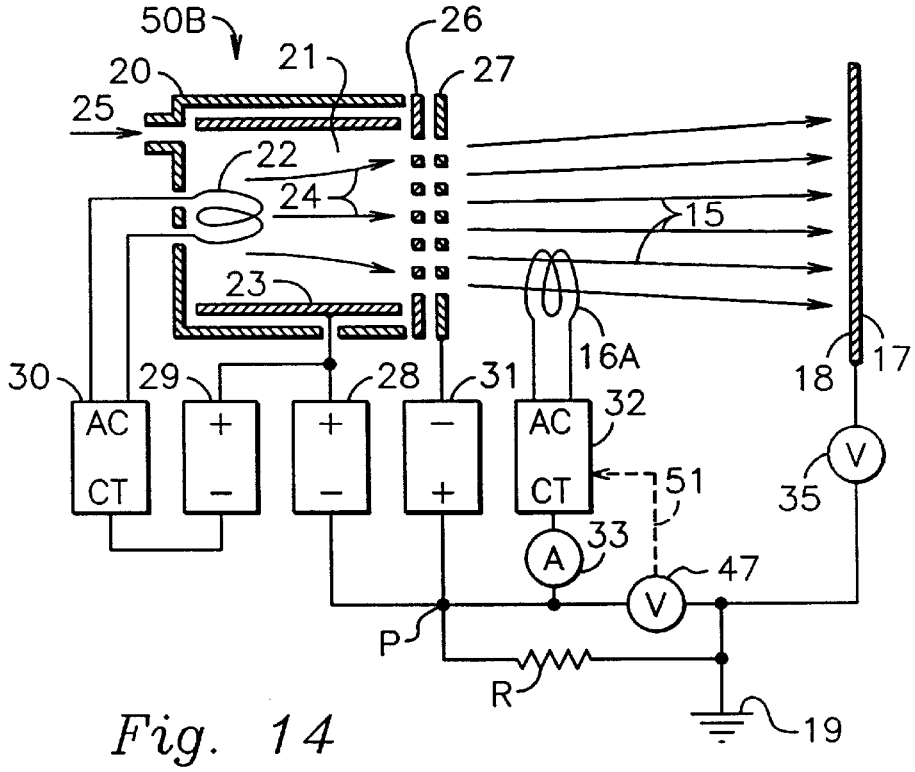
FIG. 14 is another embodiment of the present invention similar to that of FIG. 12, except that a gridded ion source is used.

Referring to FIG. 14, there is shown ion-source apparatus 50B that is an alternate embodiment of the present invention wherein the ion source is of the gridded type. Operation of the ion source is generally similar to that described for FIG. 2. The potential to accelerate the ions again comes from beam supply 28. The power to heat cathode-neutralizer 16A again comes from heater supply 32, which is again usually in the form of a secondary winding of an alternating-current transformer, with the center-tap of the secondary winding is connected to ammeter 33. The other side of the ammeter is again connected to the negative side of beam supply 28, but this common point is not connected to ground 19, but instead becomes common circuit point P which is substantially isolated from ground.

The potential of point P as indicated by the voltage of voltmeter 47 is again used to control the heater current generated by heater supply 32, with this control again indicated by dashed line 51. If the potential of point P rises above a predetermined range, the heater current is reduced, causing the potential of point P to decrease. If the potential of point P decreases below a predetermined range, the heater current is increased, causing the potential of point P to increase. Again, this control may be either manual or automatic. Different predetermined ranges of potentials could be used for point P to control the heater current, so that the electron emission capability is controlled with more or less margin compared to the actual electron emission.

Figure 15:
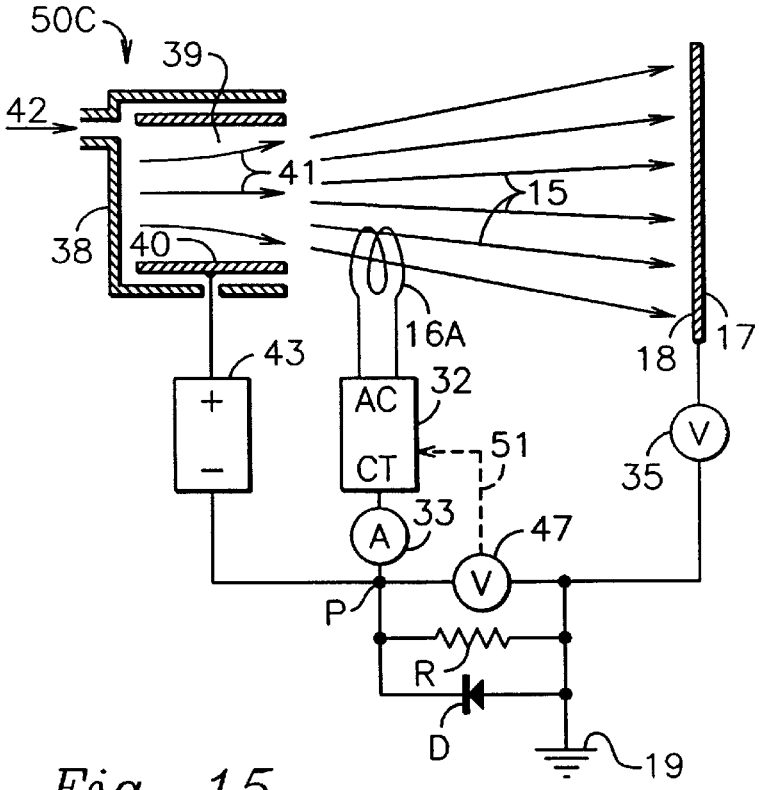
FIG. 15 is another embodiment of the present invention similar to that of FIG. 12, except that a diode D is connected across resistor R.

Referring to FIG. 15, there is shown ion-source apparatus 50C that is an embodiment of the present invention wherein the ion source is of the gridless type. Operation of the ion source is similar to that described for the embodiment of FIG. 12, except that diode D is connected across resistor R. The polarity of the diode is such that positive potentials can be sustained for common circuit point P, but not negative potentials. If the potential of point P is to be controlled within a positive range of values, the diode will not affect the control as described previously. More specifically, the substantial isolation of point P from ground 19 shall include the use of a diode, as long as the polarity of the diode is such that the presence of the diode does not affect the potential within or near the range of values for which the potential is controlled.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A method for providing a current-neutralized ion beam, the method comprising the steps of:

(a) providing a gridless ion-source means for generating an ion beam and wherein said ion-source means includes an anode;

(b) providing a discharge-supply means having a positive terminal and a negative terminal, wherein said positive terminal of said discharge-supply means is connected to said anode;

(c) providing a hot-filament cathode-neutralizer;

(d) providing a heater-supply means for generating a heater current, where said heater-supply means is connected to said cathode-neutralizer, and said heater current is sufficient to raise said cathode-neutralizer to an electron-emissive operating temperature beyond an emission threshold;

(e) providing an electrical ground which may or may not be connected to earth ground;

(f) connecting said cathode-neutralizer to a common circuit point with said negative terminal of said discharge-supply means, wherein said circuit point is substantially isolated from said electrical ground;

(g) measuring a potential of said circuit point relative to said electrical ground; and (h) controlling said heater current so as to maintain said potential of said circuit point within a predetermined range of values.

2. A method for providing a current-neutralized ion beam, the method comprising the steps of:

(a) providing a gridded ion-source means for generating an ion beam and wherein said ion-source means includes an anode;

(b) providing a beam-supply means having a positive terminal and a negative terminal, wherein said positive terminal of said beam-supply means is connected to said anode;

(c) providing a hot-filament cathode-neutralizer;

(d) providing a heater-supply means for generating a heater current, where said heater-supply means is connected to said cathode-neutralizer, and said heater current is sufficient to raise said cathode-neutralizer to an electron-emissive operating temperature beyond an emission threshold;

(e) providing an electrical ground which may or may not be connected to earth ground;

(f) connecting said cathode-neutralizer to a common circuit point with said negative terminal of said beam-supply means, wherein said circuit point is substantially isolated from said electrical ground;

(g) measuring a potential of said circuit point relative to said electrical ground; and (h) controlling said heater current so as to maintain said potential of said circuit point within a predetermined range of values.

3. A method for providing a current-neutralized ion beam, the method comprising the steps of:

(a) providing a gridded ion-source means for generating an ion beam and wherein said ion-source means includes an anode and an accelerator grid;

(b) providing a beam-supply means having a positive terminal and a negative terminal, wherein said positive terminal of said beam-supply means is connected to said anode;

(c) providing an accelerator-supply means having a positive terminal and a negative terminal, wherein said negative terminal of said accelerator-supply means is connected to said accelerator grid;

(d) providing a hot-filament cathode-neutralizer;

(e) providing a heater-supply means for generating a heater current, where said heater-supply means is connected to said cathode-neutralizer, and said heater current is sufficient to raise said cathode-neutralizer to an electron-emissive operating temperature beyond an emission threshold;

(f) providing an electrical ground which may or may not be connected to earth ground;

(g) connecting said cathode-neutralizer to a common circuit point with said negative terminal of said beam-supply means and said positive terminal of said accelerator-supply means, wherein said circuit point is substantially isolated from said electrical ground;

(h) measuring a potential of said circuit point relative to said electrical ground; and (i) controlling said heater current so as to maintain said potential of said circuit point within a predetermined range of values.

4. Apparatus for providing a current-neutralized ion beam, said apparatus comprising:

(a) gridless ion-source means for generating an ion beam, wherein said ion-source means includes an anode;

(b) discharge-supply means having a positive terminal and a negative terminal, wherein said positive terminal is connected to said anode;

(c) an electrical ground which may or may not be connected to earth ground;

(d) hot-filament cathode-neutralizer means connected to a common circuit point with said negative terminal of said discharge-supply means, wherein said circuit point is substantially isolated from said electrical ground;

(e) Heater-supply means for generating a heater current, wherein heater-supply means is connected to said hot filament cathode-neutralizer means, and wherein said heater current is sufficient to raise said cathode-neutralizer means to an electron-emissive operating temperature beyond an emission threshold;

(f) means for measuring a potential of said circuit point relative to said electrical ground; and (g) means for controlling said heater current so as to maintain said potential of said circuit point within a predetermined range of values.

5. Apparatus for providing a current-neutralized ion beam, said apparatus comprising:

(a) gridded ion-source means for generating an ion beam, wherein said ion-source means includes an anode;

(b) beam-supply means having a positive terminal and a negative terminal, wherein said positive terminal is connected to said anode;

(c) an electrical ground which may or may not be connected to earth ground;

(d) hot-filament cathode-neutralizer means connected to a common circuit point with said negative terminal of said beam-supply means, wherein said circuit point is substantially isolated from said electrical ground;

(e) Heater-supply means for generating a heater current, wherein heater-supply means is connected to said hot filament cathode-neutralizer means, and wherein said heater current is sufficient to raise said cathode-neutralizer means to an electron-emissive operating temperature beyond an emission threshold;

(f) means for measuring a potential of said circuit point relative to said electrical ground; and (g) means for controlling said heater current so as to maintain said potential of said circuit point within a predetermined range of values.

6. Apparatus for providing a current-neutralized ion beam as defined in claim 5 further comprising:

(h) an accelerator grid in said ion-source means; and (i) accelerator-supply means having a positive terminal and a negative terminal, wherein said negative terminal is connected to said accelerator grid, and wherein said positive terminal is connected to said circuit point.

* * * * *